US009597604B1

(12) United States Patent
Horikoshi

(10) Patent No.: US 9,597,604 B1
(45) Date of Patent: Mar. 21, 2017

(54) TOY TOP

(71) Applicant: TOMY COMPANY, LTD., Tokyo (JP)

(72) Inventor: Kenji Horikoshi, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/255,389

(22) Filed: Sep. 2, 2016

(30) Foreign Application Priority Data

Mar. 23, 2016 (JP) ..... 2016-058558

(51) Int. Cl.
*A63H 1/00* (2006.01)
*A63H 1/02* (2006.01)

(52) U.S. Cl.
CPC ..... *A63H 1/02* (2013.01)

(58) Field of Classification Search
USPC ..... 446/256, 257, 259, 262, 264, 266
See application file for complete search history.

(56) References Cited

U.S. PATENT DOCUMENTS 6,146,233 A * 11/2000 Hedeen, Jr. ..... A63H 1/04 446/247
6,905,389 B2 * 6/2005 Matsukawa ..... A63F 3/00895 446/256
8,066,543 B2 * 11/2011 Kitamura ..... A63F 9/16 273/110
8,870,622 B2 * 10/2014 Tsai ..... A63H 1/04 446/256
2002/0102907 A1 * 8/2002 Osawa ..... A63H 1/00 446/256
2011/0256796 A1 * 10/2011 Ujita ..... A63H 1/00 446/264
2012/0088433 A1 * 4/2012 Choe ..... A63H 1/02 446/256
2013/0052909 A1 2/2013 Tsai
2014/0302743 A1 * 10/2014 Cai ..... A63H 1/18 446/256

FOREIGN PATENT DOCUMENTS

| | | |
|---|---|---|
| JP | 3000272 | 5/1994 |
| JP | 9-38337 | 2/1997 |
| JP | 3109118 | 3/2005 |
| JP | 3158299 | 3/2010 |

OTHER PUBLICATIONS

Japan Platform for Patent Information, English Abstract for JP 09-038337, published Feb. 10, 1997.
Office Action for Japanese Patent Application No. 2016-058558, issued Jun. 21, 2016.
Notice of Allowance for Japanese Patent Application No. 2016-058558, issued Aug. 9, 2016.

* cited by examiner

*Primary Examiner* — Kurt Fernstrom
(74) *Attorney, Agent, or Firm* — Staas & Halsey LLP

(57) ABSTRACT

A toy top includes a body and a shaft part. A rotating shaft of the shaft part includes plastic or metal shaft tip segments disposed at predetermined intervals in a circumferential direction of the rotating shaft. The shaft tip segment constitutes part of an outer periphery of the rotating shaft. The part of the outer periphery is configured to come into contact with the ground. Rubber is provided at the outer periphery of the rotating shaft so as to protrude outward beyond outer surfaces of the shaft tip segments. The rubber has higher frictional force than the shaft tip segments. The rubber is disposed between adjacent shaft tip segments in the circumferential direction.

4 Claims, 7 Drawing Sheets

TOY TOP

BACKGROUND OF THE INVENTION

1. Field of the Invention

The present invention relates to a toy top.

2. Description of the Related Art

Some known battle games involving toy tops determine winning and losing of the games by launching toy tops to each other such that the impact force knocks out the toy tops of the opponents or causes ejectable components on the bodies of the toy tops to pop off (for example, refer to JP H09-038337 A and JP 3109118 U).

Although traditional toy tops have rotary shafts made of plastic or metal, recent toy tops for battle games have shafts of various elaborate designs. Examples of such a recent toy top include a toy top having a rotary shaft made of rubber.

Unfortunately, the toy top having the rubber rotary shaft that generates high frictional force during the rotation is inferior to a toy top having a plastic or metal rotary shaft in rotational continuity, although superior in aggression because of the large (rampageous) movement thereof. In other words, the toy top having the rubber rotary shaft has high aggression but low rotational continuity.

To address the problem, another toy top is disclosed which is designed to be rotated on a curved game board like a concave mirror surface. The toy top has frictional segments on the circumferential surface of the rotating shaft. The frictional segments have higher frictional force than the rotating shaft. The leading end of the rotating shaft resides below the frictional segments (see JP 3158299 U).

In the first half of the battle game, the frictional segments of the toy top come into contact with the game board, causing large and highly aggressive movement of the toy top on the game board. In the last half of the battle game, the rotating shaft having lower frictional force maintains the rotational force of the toy top, exhibiting high rotational continuity.

Unfortunately, this toy top exhibits low aggression in the last half of the battle game.

SUMMARY OF INVENTION

An object of the present invention, which has been made in view of such problems, is to provide a toy top that can maintain high aggression and high rotational continuity in a battle game.

In order to realize the above object, according to one aspect of the present invention, there is provided a toy top including:

a body; and a shaft part, wherein a rotating shaft of the shaft part includes plastic or metal shaft tip segments disposed at predetermined intervals in a circumferential direction of the rotating shaft, the shaft tip segments constituting part of an outer periphery of the rotating shaft, the part of the outer periphery being configured to come into contact with the ground, rubber is provided at the outer periphery of the rotating shaft so as to protrude outward beyond outer surfaces of the shaft tip segments, the rubber having higher frictional force than the shaft tip segments, and the rubber is disposed between adjacent shaft tip segments in the circumferential direction.

According to these configurations, the rubber of the toy top comes into contact with the game board, causing large and highly aggressive movement of the toy top in the first half of the battle game. In the last half of the battle game, the shaft tip segments constituting part of the outer periphery of the rotating shaft come into contact with the game board, maintaining the movement of the toy top. Since the shaft tip segments, which have a low frictional force and small surface area, come into contact with the game board in the last half of the battle game, the rotational continuity of the toy top can be maintained.

Preferably, the shaft tip segments include at least three shaft tip segments disposed at equal intervals in the circumferential direction.

According to these configurations, the at least three shaft tip segments disposed at equal intervals in the circumferential direction cause stable movement of the toy top in the last half of the battle game.

Preferably, a central part of the rotating shaft surrounded by the shaft tip segments is provide with the rubber which has a bottom end positioned above the bottom ends of the shaft tip segments.

According to these configurations, the rubber disposed between adjacent shaft tip segments in the circumferential direction has bottom ends positioned above the bottom ends of the shaft tip segments. Such a structure allows only the shaft tip segments, which have low frictional force and small surface areas, to come into contact with the game board in the last half of the battle game. The toy top thus can maintain higher rotational continuity than a toy top having shaft tip segments and rubber that simultaneously come into contact with the game board.

Preferably, a central part of the rotating shaft surrounded by the shaft tip segments is provide with the rubber which has a bottom end positioned above the bottom ends of the shaft tip segments.

According to these configurations, the rubber of the toy top has a bottom end positioned above the bottom ends of the shaft tip segments, generating reduced resistance applied on the toy top during the battle game. The toy top having such a structure thus can have high rotational continuity.

BRIEF DESCRIPTION OF THE DRAWINGS

The present invention is fully understood from the detailed description given hereafter and the accompanying drawings, which are given by way of illustration only and thus are not intended to limit the present invention, wherein.

DETAILED DESCRIPTION

Embodiments of a toy top according to the present invention will now be described with reference to the accompanying drawings.

<<Overall Structure>>

Figure 1:
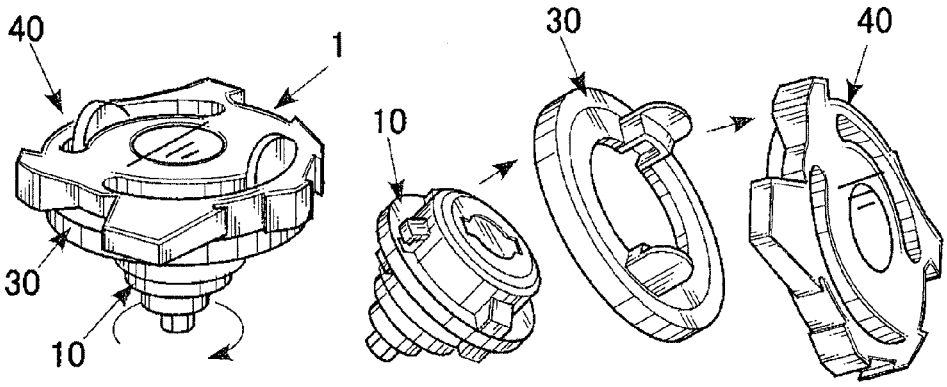
FIG. 1 illustrates the action of a toy top according to an embodiment of the present invention in the battle game.
Figure 2:
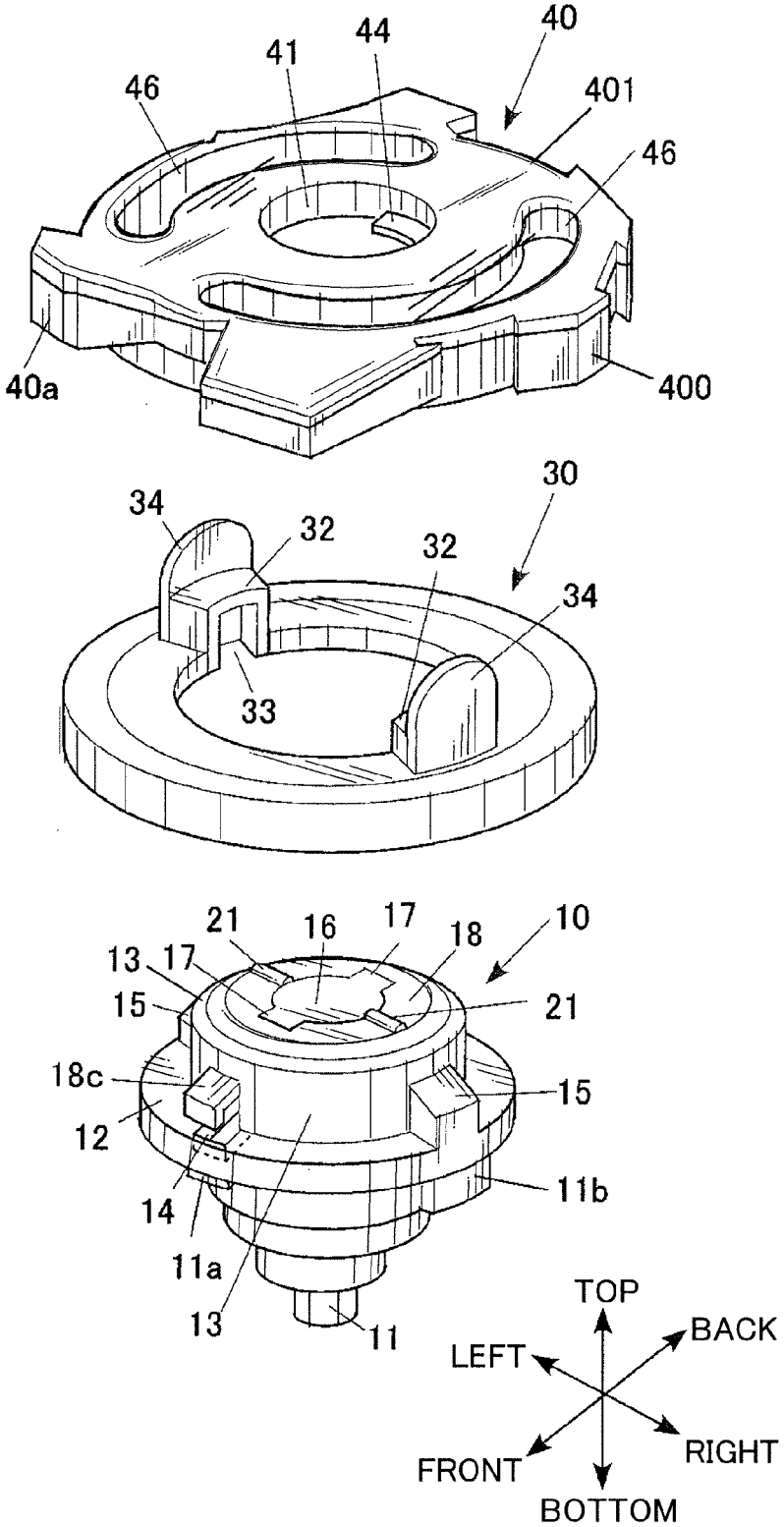
FIG. 2 is an exploded perspective view of the toy top according to the embodiment.
Figure 3:
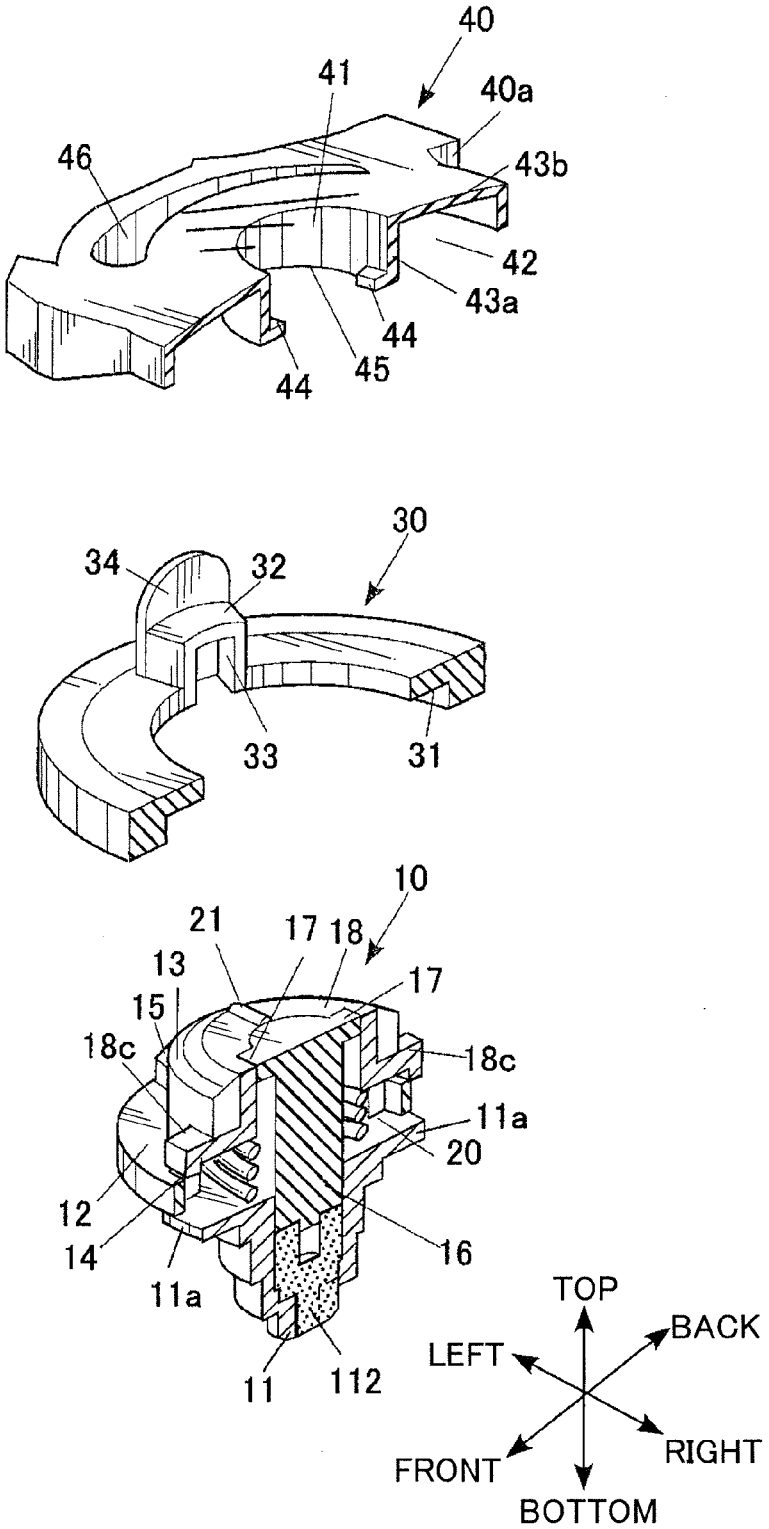
FIG. 3 is an exploded cross-sectional perspective view of the toy top according to the embodiment.

FIG. 1 illustrates the action of a toy top according to an embodiment of the present invention in the battle game. FIG. 2 is an exploded perspective view of the toy top according to the embodiment. FIG. 3 is an exploded cross-sectional perspective view of the toy top according to the embodiment. In this specification, the terms "top," "bottom," "left," "right," "front," and "back" refer to the corresponding directions in FIGS. 2 and 3.

A toy top 1 according to the embodiment can be used in "spinning top battle games." In detail, the toy top 1 can be used in a battle game in which the toy top of a winner collides with and dissembles a toy top 1 of an opponent, as illustrated on the right of FIG. 1, by the impact force.

With reference to FIGS. 2 and 3, the toy top 1 includes a shaft part 10, which constitutes a lower segment serving as a driver, and an adjuster ring 30 and a body 40, which together constitute an upper segment.

<<Detailed Structure>>

1. Shaft Part 10

With reference to FIG. 2, the shaft part 10 includes a rotating shaft 11, a flange 12 in the vertical middle of the shaft part, and a cylinder 13 in the top of the shaft part. The rotating shaft 11, the flange 12, and the cylinder 13 are composed of plastic. Alternatively, any material other than plastic may be selected. For example, part or the entirety of each component may be composed of metal.

The flange 12 is integrated with the cylinder 13. The flange 12 and the cylinder 13 are fixed to the rotating shaft 11 with screws 11*c* (refer to the bottom view in FIG. 4).

The rotating shaft 11 has a diameter stepwise decreasing from the flange 12 to the leading end of the rotating shaft 11 and thus has a substantially inverted cone shape.

Figure 4:
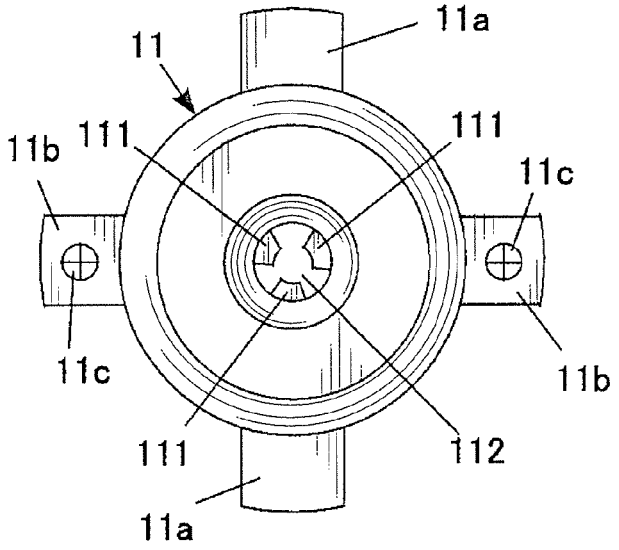
FIG. 4 is a bottom view of the rotating shaft of a shaft part of the toy top.

The flange 12 and the cylinder 13 define two holes 14 at opposite positions in the front and back across the axis of the rotating shaft 11. With reference to FIGS. 2 and 4, the upper portion of the rotating shaft 11 has projections 11*a* extending radially outward from positions corresponding to the positions of the holes 14 in the flange 12. The projections 11*a* close the holes 14 in the flange 12 from below. The top surfaces of the projections 11*a* serve as seats the function of which will be described below.

The cylinder 13 has two protrusions 15 at opposite positions in the right and left across the axis of the rotating shaft 11. The outer surfaces of the protrusions 15 are flush with the outer circumferential surface of the flange 12. With reference to FIGS. 2 and 4, the upper portion of the rotating shaft 11 has protrusions 11*b* extending radially outward from positions corresponding to the positions of the protrusions 15. The flange 12 and the cylinder 13 are fixed to the rotating shaft 11 with the screws 11*c* extending through the protrusions 15 and 11*b*.

With reference to FIG. 3, a column 16 is vertically disposed inside the cylinder 13. The column 16 is coupled to the rotating shaft 11 at its bottom end. The top end of the column 16 resides, but should not be limited to, above the top end of the cylinder 13. The top end of the column 16 has two hooks (second hooks) 17 extending radially outward from opposite positions in the front and back across the axis of the rotating shaft 11.

The shaft part 10 also includes a movable urging member 18 having a cylindrical shape. The urging member 18 is made of synthetic resin. Alternatively, the urging member 18 may be made of metal. The urging member 18 is disposed inside the cylinder 13 so as to surround the outer periphery of the column 16.

Figure 5:
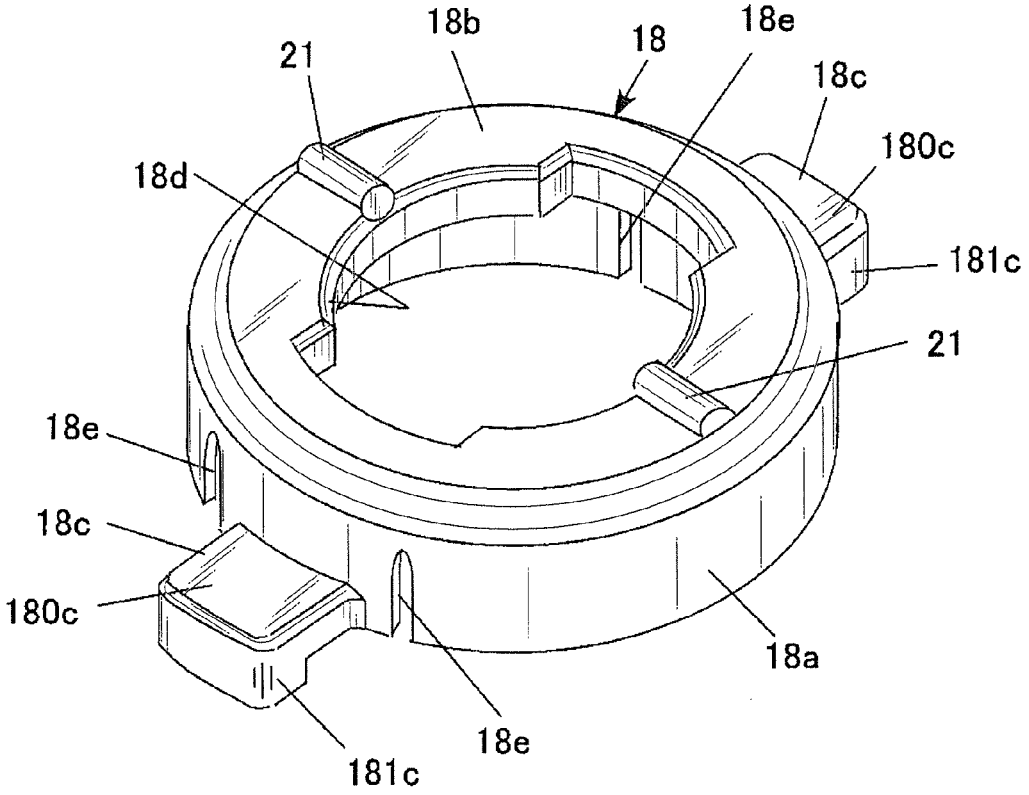
FIG. 5 is a perspective view of the urging member of the toy top.

With reference to FIG. 5, the urging member 18 consists of a cylinder 18*a*, a ceiling 18*b*, and two legs 18*c*.

The ceiling 18*b* is disposed on the top end of the cylinder 18*a*. The ceiling 18*b* has a hole 18*d* conforming to the top end of the column 16.

The two legs 18*c* are disposed on the outer periphery of the lower portion of the cylinder 18*a*. The two legs 18*c* are disposed at opposite positions in the front and back across the axis of the rotating shaft 11. Each leg 18*c* has a horizontal portion 180*c* extending horizontally from the cylinder 18*a*, and a vertical portion 181*c* extending vertically downward from the top end of the horizontal portion 180*c*.

The cylinder 18*a* has four slits 18*e* in the bottom end. The slits 18*e* are disposed adjacent to the respective two sides of each leg 18*c*. The two adjacent slits 18*e* define a supporting portion supporting each leg 18*c*. The slits 18*e* facilitate resilient deformation of the legs 18*c* and the supporting portions caused by the downward force applied on the upper portion of the urging member 18 when the legs 18*c* sit on the top surfaces of the projections 11*a*.

The urging member 18 having such a structure is disposed such that the legs 18*c* extend through the respective holes 14. The holes 14 have a vertical dimension larger than the legs 18*c*; hence, the urging member 18 is movable in the vertical direction. The upward movement of the urging member 18 is restricted when the legs 18*c* come into contact with the top edges of the holes 14, respectively. The downward movement of the urging member 18 is restricted when the legs 18*c* sit on the respective seats, which are the top surfaces of the respective projections 11*a*.

The urging member 18 is urged upward by urging force of a coil spring 20 wound around the column 16. When the shaft part 10 is separated from the body 40, each leg 18*c* of the urging member 18 is in contact with the top edge of the hole 14 by the urging force of the coil spring 20. The top end of the urging member 18 is thereby flush with the top end of the cylinder 13.

In addition, the urging member 18 has two protruding strips 21 on the top surface of the ceiling 18*b*. The two protruding strips 21 extend radially from opposite positions in the right and left across the axis of the rotating shaft 11.

Figure 6:
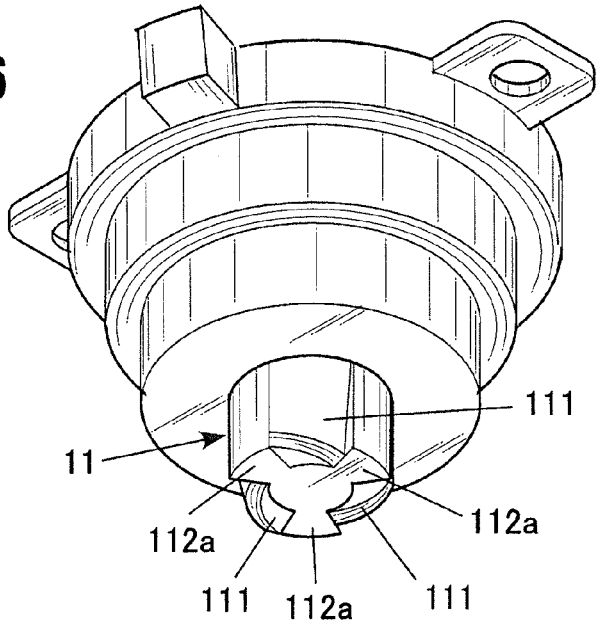
FIG. 6 is a perspective view of the rotating shaft of the shaft part of the toy top.

With reference to FIG. 6, the rotating shaft 11 has three shaft tip segments 111 disposed at predetermined distances in the circumferential direction in this embodiment. Alternatively, two or at least four shaft tip segments 111 may be provided. Rubber pieces 112*a* having larger frictional force than the shaft tip segments 111 are each disposed between two adjacent shaft tip segments 111 in the circumferential direction. The number of the rubber pieces 112*a* is identical to that of the shaft tip segments 111. In this embodiment, part of each rubber piece 112*a* is flush with the outer surfaces of the shaft tip segments ill or extends radially outward beyond the outer surfaces of the shaft tip segments 111 of the rotating shaft 11. Such rubber pieces 112*a* readily come into contact with the surface of a game board in the first half of a battle game. The bottom ends of the rubber pieces 112*a* reside above the bottom ends of the shaft tip segments 111.

Such a structure allows only the shaft tip segments 111 to readily come into contact with the game board in the last half of the battle game.

Figure 7:
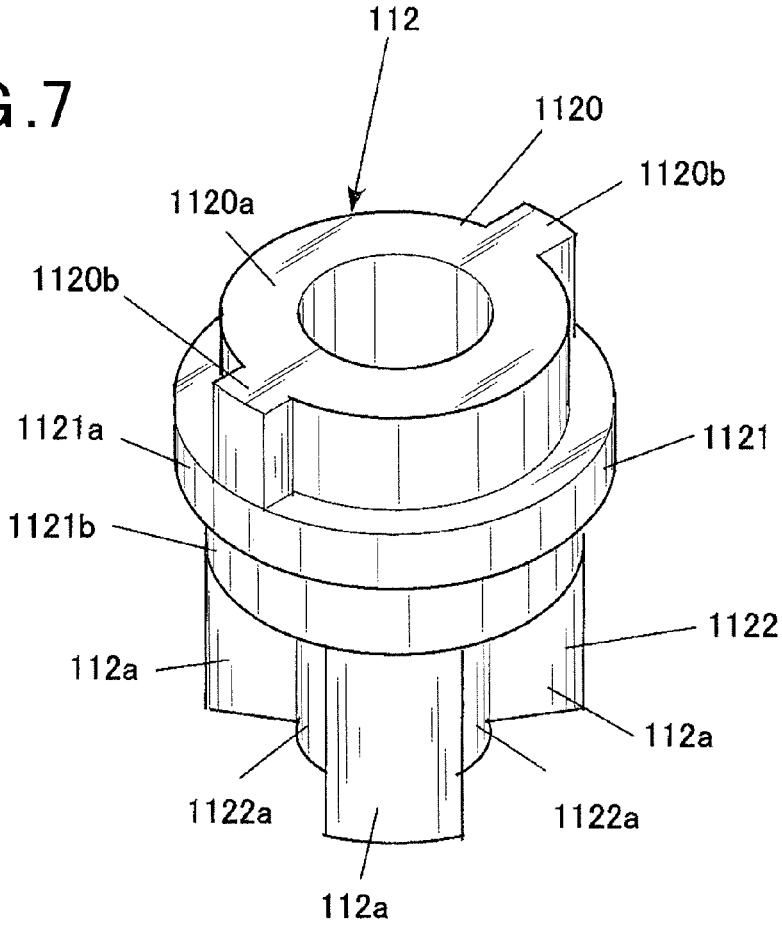
FIG. 7 is a perspective view of the rubber body of the toy top.

With reference to FIG. 7, the three rubber pieces 112*a* constitute part of a rubber body 112. As illustrated in FIG. 6, the rubber body 112 has a substantially cylindrical shape.

The rubber body 112 has an upper region 1120, a middle region 1121, and a lower region 1122. The upper region 1120 has a cylinder 1120*a*. The cylinder 1120*a* has projections 1120*b* extending radially outward from opposite positions across the central axis of the cylinder 1120*a*. The middle region 1121 includes a large discoid portion 1121*a* having a larger diameter and a small discoid portion 1121*b* having a smaller diameter. The large discoid portion 1121*a* is joined to the bottom ends of the cylinder 1120*a* and the projections 1120*b*. The small discoid portion 1121*b* is joined to the bottom end of the large discoid portion 1121*a*. The lower region 1122 has a central column 1122*a* and rubber pieces 112*a*. The column 1122*a* is joined to the bottom end of the small discoid portion 1121*b*. The top ends of the rubber pieces 112*a* are joined to the bottom end of the small discoid portion 1121*b*, and the inner ends of the rubber pieces 112*a* are joined to the column 1122*a*. Each rubber piece 112*a* has a substantially fan-shaped horizontal cross section.

The rubber pieces 112*a* disposed on the bottom end of the rubber body 112 extend radially outward from the column 1122*a*. The bottom end of the column 1122*a* is flush with the bottom ends of the rubber pieces 112*a*. The bottom end of the column 1122*a* of the rubber body 112 thereby resides above the bottom ends of the shaft tip segments 111 disposed on the two sides of each rubber piece 112*a* in the circumferential direction. The bottom end of the column 1122*a* of the rubber body 112 therefore does not come into contact with the surface of a game board during a battle game.

The rubber body 112 having such a structure is fit into the rotating shaft 11 from above such that each rubber piece 112*a* is disposed between two adjacent shaft tip segments 111 in the circumferential direction. In another embodiment, a rubber body that has smaller dimensions than the rubber body 112 is fit into the rotating shaft 11 from the bottom end of the rotating shaft 11 such that each rubber piece 112*a* is disposed between two adjacent shaft tip segments 111.

2. Adjuster Ring 30

According to this embodiment, the adjuster ring 30 is a flywheel. The adjuster ring 30 is formed as a plate. The adjuster ring 30 has an annular step 31 provided on its bottom surface for receiving the flange 12 of the shaft part 10 to be inserted from below. The top surface of the adjuster ring 30 has two protrusions 32 extending upward from opposite positions in the left and right across the axis of the rotating shaft 11. The protrusions 32 each has a depression 33 on the bottom side, for receiving the protrusions 15 of the shaft part 10 to be inserted from below. The top surface of the adjuster ring 30 has tongues 34 adjoining the outer faces of the protrusions 32 and extending upward. The tongues 34 protrude above the protrusions 32. The outer circumferential surface of the adjuster ring 30 may have additional protrusions for an effective attack on a toy top 1 of an opponent or additional depressions for an effective defense against an attack by the toy top 1 of the opponent. The protrusions or depressions may be provided in place of the flywheel or may be integrated with the flywheel.

3. Body 40

The body 40 has a discoid shape. With reference to FIG. 2, the body 40 includes a base 400 and a transparent cover 401 covering the base 400 and having a substantially identical shape to the base 400 in top view.

The body 40 has projections and recesses 40*a* on its outer periphery. The base 400 has a circular hole 41 in its center. The upper end of the circular hole 41 is covered with the transparent cover 401. The bottom surface of the body 40 has an annular depression 42 for receiving the protrusions 32 of the adjuster ring 30 to be inserted from below. The inner circumferential wall 43*a* defining the annular depression 42 has, at the bottom edge, two hooks (first hooks) 44 protruding radially inward from opposite positions in the front and back across the axis of the rotating shaft 11.

The bottom surface of the inner circumferential wall 43*a* has two sliding contact regions 45 disposed at opposite positions in the left and right across the axis of the rotating shaft 11. The sliding contact regions 45 are to be in sliding contact with the respective protruding strips 21. Each sliding contact region 45 tilts in a predetermined direction from a (horizontal) plane perpendicular to the axis of the rotating shaft 11. That is, each sliding contact region 45 tilts in a direction along which resistance of the body 40 with respect to the shaft part 10 increases when the body 40 is rotated in such a direction that the body 40 is uncoupled from the shaft part 10. In detail, each sliding contact region 45 is gradually inclined downward from the deepest coupled position toward the uncoupled position. The sliding contact regions 45 can hold the respective protruding strips 21 at any positions. Such a structure is different from a structure including a mere protrusion having tilted surfaces.

A ceiling 43*b* defining the annular depression 42 of the body 40 has arcuate slits 46 through which the tongues 34 of the adjuster ring 30 are insertable from below. The arcuate slits 46 are long enough for the tongues 34 to move therein.

<<Assembling Process>>

An exemplary assembling process of the toy top 1 will now be described. The following description presupposes that the shaft part 10 has been already assembled.

Figure 8A:
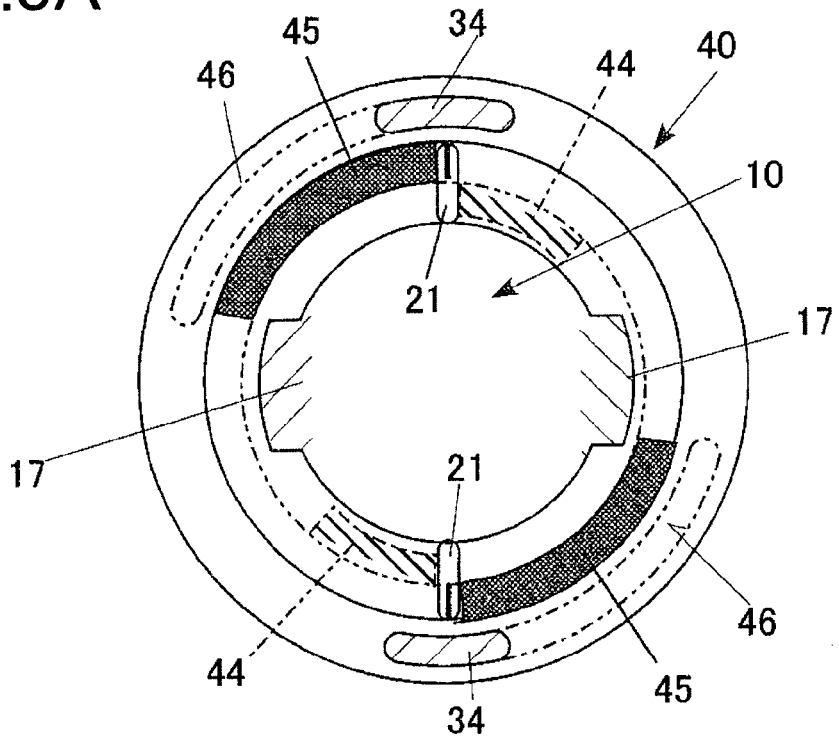
FIG. 8A is an operational view of the shaft part, the body, and the flywheel of the toy top according to the embodiment.
Figure 8B:
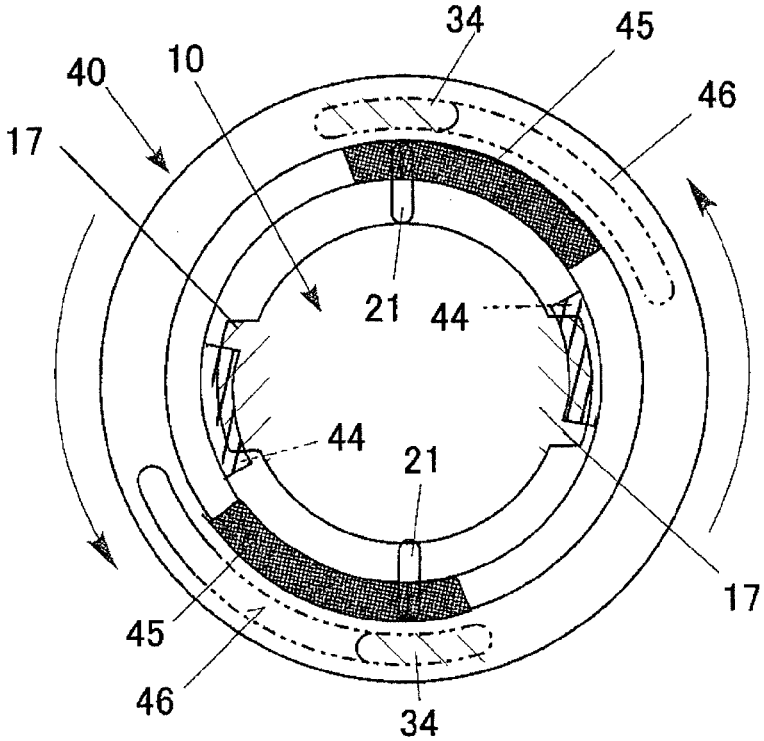
FIG. 8B is an operational view of the shaft part, the body, and the flywheel of the toy top according to the embodiment.

The assembling process starts with coupling the shaft part 10 to the adjuster ring 30 such that the protrusions 15 of the shaft part 10 are fit in the respective depressions 33 of the adjuster ring 30 from below. The coupled components are then coupled to the body 40 from below such that each tongue 34 of the adjuster ring 30 is disposed at a predetermined edge of the corresponding arcuate slit 46 of the body 40 (FIG. 8A). In this state, the hooks 17 of the shaft part 10 do not overlap with the respective hooks 44 of the body 40. This state is referred to as an "uncoupled state". The shaft part 10 coupled to the adjuster ring 30 is then pressed onto the body 40, so that the adjuster ring 30 is urged against the bottom surface of the body 40. The shaft part 10 coupled with the adjuster ring 30 is further pressed onto the body 40, so that the legs 18*c* of the shaft part 10 are urged by the bottom surface of the adjuster ring 30 to a downward direction opposite to the direction of the urging force of the coil spring 20. The legs 18*c* thereby sit on seats, which are the top surfaces of the projections 11*a*. The shaft part 10 coupled to the adjuster ring 30 is still further pressed onto the body 40, so that the legs 18*c* and the supporting portions of the urging member 18 are resiliently deformed, the coil spring 20 is further compressed, and the hooks 17 of the shaft part 10 are biased above the hooks 44 of the body 40. The shaft part 10 and the adjuster ring 30 are then integrally rotated relative to the body 40 until each tongue 34 is moved to the other edge of the corresponding arcuate slit 46 (FIG. 8B). The rotation between the body 40 and the shaft part 10 coupled to the adjuster ring 30 is a relative rotation, and FIG. 8B illustrates the rotation of the body 40 relative to the shaft part 10 coupled to the adjuster ring 30. The hooks 44 of the body 40 overlap with the respective hooks 17 of the shaft part 10. When the user's hand is released from the shaft part 10, the bottom surfaces of the respective hooks 17 of the shaft part 10 are brought into contact with the top surfaces of the hooks 44 of the body 40 by the resilient force of the legs 18*c* and the supporting portions of the urging member 18 and the urging force of the coil spring 20. Upon the contact of the bottom surfaces of the hooks 17 of the shaft part 10 with the top surfaces of the respective hooks 44 of the body 40, the resilient force of the legs 18*c* and the supporting portions of the urging member 18 may be released. In another embodiment, the legs 18*c* may be brought upward from the respective projections 11*a* after the release of the resilient force of the legs 18*c* and the supporting segments of the urging member 18. The protruding strips 21 may thereby be brought into contact with the respective sliding contact regions 45 only by the urging force of the coil spring 20.

The state where the bottom surfaces of the hooks 17 of the shaft part 10 are in contact with the top surfaces of the respective hooks 44 of the body 40 is referred to as a "coupled state". The shaft part 10, the adjuster ring 30, and the body 40 are assembled into the toy top 1 through the process described above.

<<How to Play>>

An example of how to play with the toy top 1 will now be described.

In this example, the toy top 1 is rotated to engage in a "battle" with another toy top 1.

Figure 10:
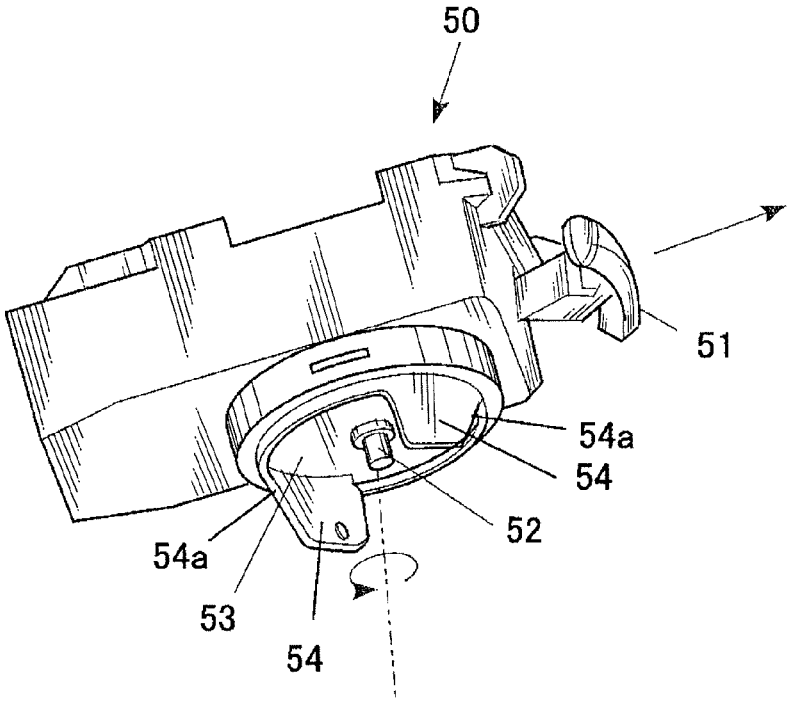
FIG. 10 is a perspective view of an exemplary launcher for rotating the toy top according to the embodiment.

The toy top 1 is charged with the rotational force with a launcher 50 as illustrated in FIG. 10. The launcher 50 includes an internal disk (not shown). The disk is urged in a first rotational direction by a spiral spring (not shown). A handle 51 is then pulled to pull a string (not shown) wound around the disk so as to rotate the disk, thereby rotating a top holder 53. The rotation of the top holder 53 is transmitted to the toy top 1 through tabs 54 protruding downward so as to rotate the toy top 1. The tabs 54 are inserted into the arcuate slits 46 of the body 40. Fully pulling the handle 51 of the launcher 50 stops the rotation of the disk and thus the rotation of the top holder 53, but the toy top 1 continues to rotate due to inertia. The toy top 1 follows the tilting faces 54*a* of the tabs 54 and detaches from the top holder 53. In FIG. 10, reference numeral 52 denotes a rod that is retractable in the top holder 53. When the toy top 1 is mounted on the top holder 53, the rod 52 is pushed into the top holder 53 by the top surface of the toy top 1. The rod 52 detects the attachment or detachment of the toy top 1, for example.

The toy top 1 launched in this way rotates in a predetermined field and collides with another toy top 1 of an opponent. The impact force and frictional force generated by the collision generate a reactive force at the body 40 in a direction opposite to the rotational direction of the shaft part 10 and the adjuster ring 30. This causes the body 40 to rotate in an opposite direction relative to the rotational direction of the shaft part 10 and the adjuster ring 30.

Figure 9:
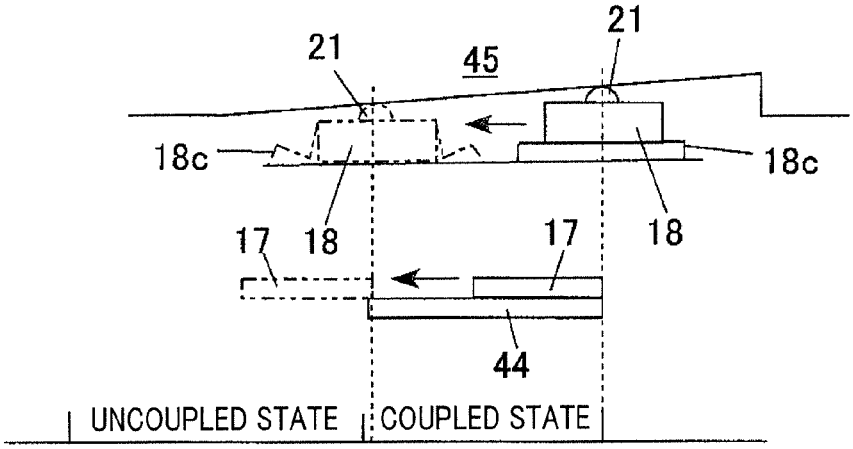
FIG. 9 illustrates the movement of the urging member of the toy top according to the embodiment.

This rotation causes sliding contact between the sliding contact regions 45 of the body 40 with the respective protruding strips 21. After loss of the impact force generated by the collision, the protruding strips 21 are fixed at certain positions by the resilient force of the legs 18*c* and the supporting portions of the urging member 18 and the urging force of the coil spring 20. As illustrated in FIG. 9, each protruding strip 21 depicted with the solid line moves to the uncoupled position depicted with the two-dot chain line, so that the hooks 44 of the body 40 detach from the hooks 17 of the shaft part 10, causing detachment of the body 40 from the shaft part 10 by the urging force of the coil spring 20. The toy top 1 is thereby disassembled as illustrated in the right of FIG. 1.

In this embodiment, the protruding strips 21 come into sliding contact with the sliding contact regions 45 of the body 40 and are fixed at certain positions by the resilient force of the urging member 18 and the urging force of the coil spring 20 after the loss of the impact force generated by the collision, gradually moving the body 40 from the shaft part 10 toward the uncoupled position. In another embodiment, any one of the body 40 and the shaft part 10 may have first depressions or first protrusions, and the other may have second protrusions or second depressions to engage with the first depressions or first protrusions. At each application of the impact force, the shaft part 10 may rotate relative to the body 40 so that the engaging positions between the depressions and the protrusions are changed, gradually moving the body 40 from the shaft part 10 toward the uncoupled position. In this embodiment, the urging member 18 may be omitted.

The operation of the toy top 1 will now be described.

The toy top 1 is launched from the launcher 50 to a position remote from the center of the game board having a surface like the concave mirror surface or bowl-shaped surface. The rubber pieces 112*a* of the toy top 1 then intermittently come into contact with the game board. The intermittent contact of the rubber pieces 112*a* with the game board causes large movement of the toy top 1, resulting in high aggression of the toy top 1 in the first half of the battle game.

In this embodiment, each rubber piece 112*a*, which is disposed between two adjacent shaft tip segments 111 in the circumferential direction, intermittently come into contact with the game board. Such intermittent contact of the rubber pieces 112*a* causes larger movement of the toy top 1 than continuous contact of rubber pieces disposed on the entire outer periphery of the rotating shaft 11.

As the rotational force of the toy top 1 which largely moved gradually diminishes, the toy top 1 moves toward the deepest area of the game board in the last half of the battle game. At the deepest area, only the shaft tip segments 111 of the toy top 1 come into contact with the game board. Since the shaft tip segments 111 are disposed remote from the center of the rotating shaft 11, the toy top 1 moves around, though less aggressively than in the first half of the battle game. The aggression of the toy top 1 thereby can be maintained. In addition, since the gap portions adjacent to the center of the rotating shaft 11 and the center part of the rotating shaft 11 do not come into contact with the game board, the rotational continuity can be maintained.

The present invention should not be limited to the embodiments described above and may be modified in various ways without departing from the scope of the invention.

In the above embodiments, each rubber piece 112*a* is disposed between two adjacent shaft tip segments 111 in the circumferential direction; alternatively, the rubber pieces 112*a* may be disposed on the entire periphery.

The bottom ends of the shaft tip segments 111 of the rotating shaft 11 may be flush with the bottom ends of the rubber pieces 112*a* disposed on the outer circumferential region of the rotating shaft 11 so that the rubber pieces 112*a* and the shaft tip segments 111 come into contact with the surface of the game board in the last half of the battle game. Also in this embodiment, the central rubber portion does not come into contact with the game board; hence, the toy top 1 according to this embodiment can have higher rotational continuity than a toy top having a rotating shaft of which entire bottom end comes into contact with the game board.

This U.S. patent application claims priority to Japanese patent application No. 2016-058558 filed on Mar. 23, 2016, the entire contents of which are incorporated by reference herein for correction of incorrect translation.

What is claimed is:

1. A toy top comprising:

a body; and a shaft part, wherein a rotating shaft of the shaft part includes plastic or metal shaft tip segments disposed at predetermined intervals in a circumferential direction of the rotating shaft, the shaft tip segments constituting part of an outer periphery of the rotating shaft, the part of the outer periphery being configured to come into contact with the ground, rubber is provided at the outer periphery of the rotating shaft so as to protrude outward beyond outer surfaces of the shaft tip segments, the rubber having higher frictional force than the shaft tip segments, and the rubber is disposed between adjacent shaft tip segments in the circumferential direction.

2. The toy top according to claim 1, wherein the shaft tip segments comprises at least three shaft tip segments disposed at equal intervals in the circumferential direction.

3. The toy top according to claim 1, wherein the rubber disposed between adjacent shaft tip segments in the circumferential direction has a bottom end positioned above bottom ends of the shaft tip segments.

4. The toy top according to claim 1, wherein a central part of the rotating shaft surrounded by the shaft tip segments is provide with the rubber which has a bottom end positioned above the bottom ends of the shaft tip segments.

* * * * *